United States Patent [19]

Blanchard

[11] Patent Number: 5,015,920

[45] Date of Patent: May 14, 1991

[54] SUPERCONDUCTING DEVICE FOR INJECTION OF ELECTRONS INTO ELECTRON TUBES

[75] Inventor: Pierre Blanchard, Verrieres le Buisson, France

[73] Assignee: Thomson-CSF, Puteaux, France

[21] Appl. No.: 372,824

[22] Filed: Jun. 27, 1989

[30] Foreign Application Priority Data

Jul. 5, 1988 [FR] France ..... 88 09063

[51] Int. Cl.[5] ..... H01J 7/24

[52] U.S. Cl. ..... 315/111.81; 315/5; 313/231.01; 250/427

[58] Field of Search ..... 315/111.81, 5, 5.33; 313/335, 231.01, 232; 505/887; 250/427, 492.3

[56] References Cited

U.S. PATENT DOCUMENTS 2,484,643 10/1949 Peterson ..... 315/5.33
2,853,646 9/1958 Geisler, Jr. ..... 315/5.33 X
2,917,653 12/1959 Noiles ..... 313/335 X
4,058,697 11/1977 Sokolov et al. ..... 250/492.3 X
4,414,487 11/1983 Yamashita et al. ..... 315/5
4,527,091 7/1985 Preist ..... 315/5
4,749,912 6/1988 Hara et al. ..... 250/427 X

FOREIGN PATENT DOCUMENTS 60-7046 1/1985 Japan .

*Primary Examiner*—Eugene R. Laroche
*Assistant Examiner*—Do Hyun Yoo
*Attorney, Agent, or Firm*—Roland Plottel

[57] ABSTRACT

A device for the injection of electrons into an electron tube, having: a superconductive bar, a first end of which enters the tube, and an electrical supply. The bar acts as a cathode. Two anodes, a main anode and a secondary anode are placed in the tube, respectively in the place where the electrons are collected and in the place where the first end of the bar enters. The electrical supply provides for application of two voltages, a main voltage and a secondary voltage. Electrons are accelerated along the bar through the two voltages and acquire a kinetic energy which is at least equal to the energy of extraction from the superconductor, and are thus ejected outside the bar.

14 Claims, 5 Drawing Sheets

SUPERCONDUCTING DEVICE FOR INJECTION OF ELECTRONS INTO ELECTRON TUBES

An object of the present invention is a device for the injection of electrons into an electron tube which turns to advantage the high speed that may be acquired by electrons accelerated by an electrical field in a superconducting material. These electrons are, in effect, capable of acquiring a level of kinetic energy which is at least equal to the energy, hereinafter called the extraction energy, that they need to cross the potential barrier that initially confines them to the material.

BACKGROUND OF THE INVENTION

1. Field of the Invention

The working of any electron tube is based on the existence, inside the tube, of an electron beam. Any electron tube should be provided with an electron injecting device. The characteristics of the electron beam given, for example its intensity and its directivity, vary according to the type of tube considered. Nevertheless, in most cases, it is necessary to have a substantially parallel, narrow and intense electron beam. These constraints are, for example, indispensable for fitting out a microwave tube, such as a travelling wave tube or a klystron or a Crookes' tube (X-ray emitter) or a cathode-ray tube.

2. Description of the Prior Art

There are prior art electron injecting devices designed to be fitted into an electron tube. A frequently used prior art device uses thermoelectronic emission, namely, the emission of electrons by certain metals (hereinafter called thermoemissive metals) when they are heated, the intensity of this emission being all the greater as the metals are hot. This prior art device generally has a heat conducting plate, one face of which is coated with a layer of a thermoemissive metal and is pointed towards that zone of the tube where the electrons have to be injected. This plate forms a cathode and is heated by means of a filament in which there flows an electrical current. An anode is placed in the tube. The current created by the electrons emitted by the heated tube increases, at a given temperature, and for a given emissive surface, with the difference in potential applied between the cathode and the anode, and then reaches a saturation value which is all the greater as the temperature is high. This current is therefore limited by the very principle of operation of the prior art device.

Another prior art device works according to the same principle, but has a different geometry: the plate is replaced by a hollow cylinder, the external surface of which is coated with a thermoemissive metal, and the filament is in the hollow of the cylinder.

These two prior art devices have two main drawbacks, in addition to the above-mentioned limits, based on their working principle, on the electron current that they can provide. Firstly, they generate a divergent electron beam (as thermoelectronic emission is a substantially isotropic phenomenon, the directions in which the electrons ejected outside the thermoemissive material are emitted are distributed in a cone corresponding to a solid angle substantially equal to $2\pi$ steradian) and, consequently, need to be accompanied by devices for the concentration of the directions of the emitted electrons, thus increasing the complexity of the means for injecting electrons into the tube. Secondly, these prior art devices have a duration of use restricted by a deterioration of the thermoemissive metal layer (this layer carried to high temperature, tends to get sublimated, i.e. to go from the solid state to the gaseous state).

SUMMARY OF THE INVENTION

The device according to the invention is based on a different principle from the one explained above. For, this device turns to advantage one of the properties of a superconductive material, namely the high mobility of the electrons in a superconductor. The device according to the invention comprises, in effect, a bar made of a superconductive material of pre-determined length, a first end of which goes into the tube while the second end is connected to electrical power supply means so that the bar acts as a cathode. An anode, hereinafter called the main anode, is located in the tube and taken to a so-called main voltage. The cathode and the main anode are preferably and respectively at a first end and a second end of the tube. Electrons are accelerated along the bar, and reach the first of its ends with a kinetic energy greater than or substantially equal to the energy of extraction from the superconductive material. These electrons are then ejected outside the first end of the bar and injected into the tube, in a direction that is substantially parallel to the axis of the bar. The treatment to which the electrons are then subjected depends on the type of electron tube considered. An anode, hereinafter called a secondary anode, is placed in that part of the tube where the electrons are injected, and is taken to a so-called secondary voltage. To trigger the injection phenomenon, the secondary voltage is taken to a starting value which is high and independent of the main voltage. Then, it is carried to a lower operating value which is smaller than the voltage to which the main anode is taken.

More precisely, an object of the invention is a device for the injection of electrons into an electron tube, comprising:

a bar of pre-determined length made of a superconductive material having a pre-determined energy of extraction, a first end of said bar entering an injection part of said tube;

electrical supply means enabling the application of a main voltage between a first end of said bar, said bar acting as a cathode, and a main anode located in a receiving part of the tube, said main voltage enabling electrons to be accelerated along said bar, so as to acquire a kinetic energy which is at least equal to the energy of extraction from the material forming the bar, and so as to be ejected outside the bar, through its first end, and be injected into said injection part of the tube;

means to trigger the electron injection phenomenon.

The device obtained overcomes the drawback of prior art devices. For, the intensity of the electron beam generated is in no way limited by the principle of creation of this beam. The directions in which the electrons are emitted are all substantially parallel to the axis of the bar. The temperature of the cathode is smaller than the critical temperature of the superconductive material, and this cathode has no thin surface deposit. The device does not get worn out like prior art devices.

BRIEF DESCRIPTION OF THE DRAWINGS

Special features and various embodiments of the invention will appear in the following description, made with reference to the appended figures, of which.

In the figures, firstly, the proportions of the various elements have not been maintained and, moreover, the same references are repeated for the same elements.

DESCRIPTION OF PREFERRED EMBODIMENTS

Figure 1:
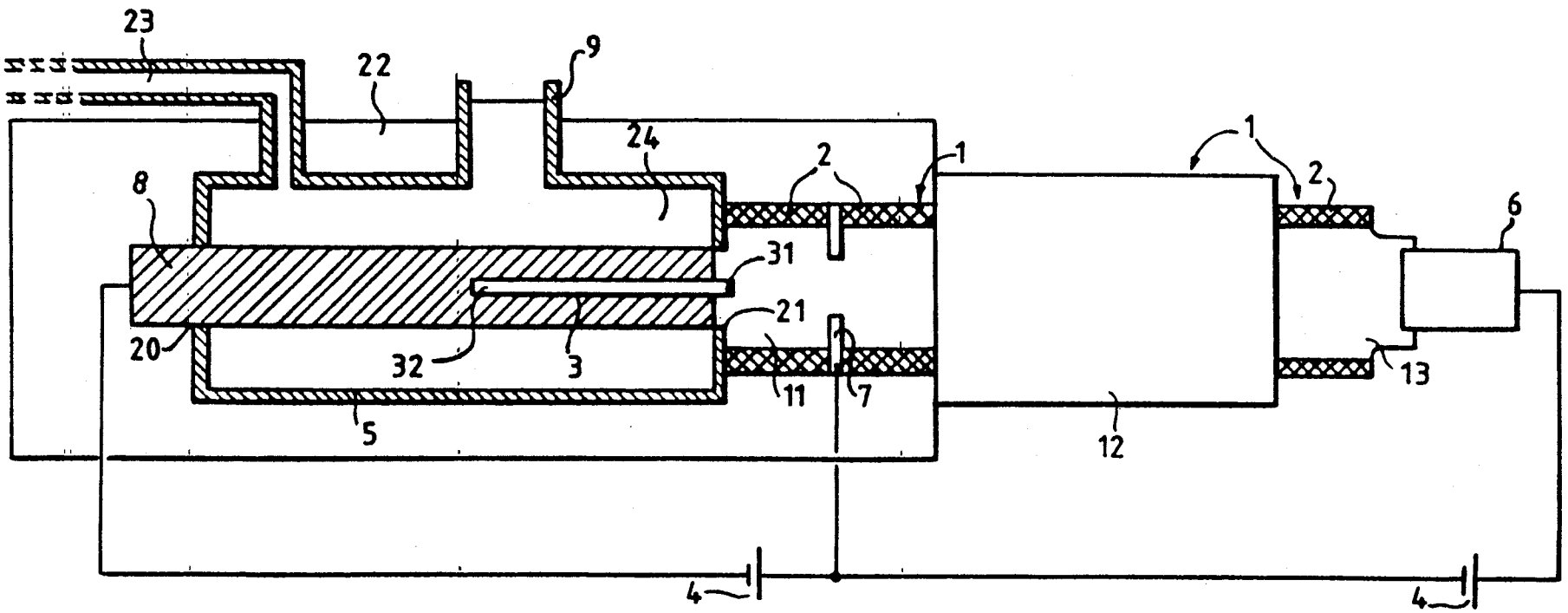
FIG. 1 shows a section of a first embodiment of the device according to the invention.

The following description shall be given by way of an example, with respect to a case where the material forming the bar is not superconductive at ambient temperature, and becomes superconductive when it is cooled to the temperature of liquid nitrogen. Nevertheless, the use of a superconductive material having a very different critical temperature comes within the scope of the invention.

In these different figures, a device according to the invention is fitted to an electron tube 1 which may be divided, in abstract terms, into three parts:

a part 11 where the electrons are injected, hereinafter called an injection part;

a part 12 where the electrons are processed, hereinafter called a processing part (a processing of electrons such as this depends on the type of tube considered);

a part 13 where the electrons are collected after processing, hereinafter called a receiving part.

The processing part 12, which has a very precise geometry that depends on the type of tube considered, is shown very schematically by a rectangle. The injection part 11 and the receiving part 13 are demarcated by walls 2 of the tube 1, which are, for example, made of ceramic.

FIG. 1 shows a first embodiment of the device according to the invention, comprising:

a thin bar 3, hereinafter also called a rod, made of a first material, which is superconductive, acting as a cathode and having one end 31 that goes into the injection part 11 of the tube 1;

an anode (called a main anode) 6 located on the receiving part 13 of the tube 1;

an anode (called a secondary anode) 7, located in the injection part 11 of the tube 1;

electrical supply means 4, providing for the application of two independent voltages, respectively called a main voltage and a secondary voltage, respectively applied between, one the one hand, the main anode and the secondary anode and, on the other hand, the cathode formed by the rod 3.

The rod 3 is electrically connected to the supply means 4 by means of a part 8 so as to avoid adverse effects on the superconductivity of the rod 3 through heating during the passage of an intense electrical current. This part 8 further fulfills a function of giving mechanical rigidity to the rod 3. By way of example, this part 8 is made of a second material which is electrically conductive (such as copper for example) and is shaped like a bar with transversal dimensions greater than those of the rod 3. The rod 3 is embedded substantially throughout its length, along its second end 32 side, in this part 8 so that only the first end 31 of this rod 3 goes beyond the part 8.

The device of FIG. 1 further has cooling means that keep the material forming the rod 3 in a superconducting state. This material is cooled by means of the part 8, the material forming this part 8 further being a heat conductor. This part 8 is, in effect, submerged in a tank 5 which is filled with liquid nitrogen 24. This tank 5 tightly grips the two ends of the part 8 by means of a brazing for example, at two holes 20 and 21 (hereinafter respectively called second and third holes). The rod 3 extends as little as possible beyond the tank 5 through the third hole 21. The tank 5 is, in effect, rigidly and tightly fixed to the walls 2 of the tube 1 so that the third hole 21 opens out into the injection part 11 of the tube 1. For example, the walls 2 of the tube 1 are made of ceramic and the tank 5 is made of Kovar, thus enabling a fixing of this type to be done by brazing. The tank 5 is further connected to a liquid nitrogen tank by means of a conduit 23, and is exposed to the open air at a hole 9 (hereinafter called the first hole). In a manner known to those skilled in the art, liquid nitrogen 24 is permanently supplied to the tank 5 and permanently evaporates through the first hole 9. The part 8 is long enough for the rod 3 to remain at low temperature, although the part 8 is in contact with the outside of the tank. Finally, heat insulation means 22, known per se, almost entirely surround the entire container 5 and at least partially surround the injection part 11 of the tube 1. These means 22, in particular, reduce heat losses and protect users.

During operation, the electrons that are given by the supply means 4 and have reached the part 8 are accelerated towards the injection part 11 of the tube 1. They go into the superconductive rod 3 at its second end 32, and are consequently accelerated throughout the length of the rod 3. This length is pre-determined so that electrons that have been accelerated by the electrical field, corresponding to the voltages created by the electrical supply means 4, have acquired a kinetic energy which is at least equal to the energy of extraction from the material forming the rod 3. This ensures the injection, into the tube, of sustantially all the electrons accelerated all along the rod 3. The electron beam obtained is therefore intense. It is, furthermore, appreciably parallel and directed in the direction of the rod 3. Finally, its transversal dimensions are substantially demarcated by those of the rod 3. The electrons injected into the injection part 11 of the tube 1 stay together through the fact that the secondary anode is given an an appropriate shape, known per se to those skilled in the art. They are then guided towards the main anode 6 (the secondary voltage being smaller than the main voltage after the triggering of the injection phenomenon) and go through the processing part 12 of the tube 1 before being collected in the reception part 13 of the tube.

The operation described in the above paragraph is preceded by a starting up stage during which the secondary voltage is far higher than during operation when it may be zero. In effect, electrons initially located in the rod 3 are accelerated towards the first end 31 of this rod 3, through the voltages applied by the electrical supply means 4, but this acceleration occurs only over a distance smaller than the length of the rod 3. Electrons such as this are not injected into the tube, remain confined in the first end 31 of the rod 3 and, consequently, repel the electrons coming from the supply means 4 which, for their part, could be injected into the tube.

The secondary voltage is therefore carried to a value, hereinafter called a starting up value, which suffices to trigger the phenomenon of ejection of electrons outside the rod 3 by tearing out the electrons that have collected at its first end 31 and block the ejection of electrons coming from the supply means 4. Once the injection phenomenon has been triggered, the secondary voltage is reduced to a value, hereinafter called an operating value, smaller than the starting value. The starting value of a secondary voltage is independent of the value of the main voltage (which is the same during the triggering of the injection phenomenon and during operation). By contrast, the operating value of the secondary voltage is smaller than the value of the main voltage so that electrons injected into the injection part 11 of the tube 1 are guided towards the processing part 12, and then collected in the reception part 13 of this tube, as explained above.

Naturally, it is possible to conceive of means to trigger the phenomenon, other than that of using a secondary anode, without going beyond the scope of the invention.

Owing to the respective transversal dimensions of the part 8 and the rod 3, and owing to the electrical conductivity of this part 8, a very small fraction of the electrons given by the supply means 4 remain in the part 8 (without going into the superconducting rod 3) up to that portion of this part 8 located on the injection part 11 side of the tube 1. Electrons such as this, hereinafter called residual electrons, having been moved in a non-superconductive material, do not have sufficiently high energy to be injected into the tube: they get collected in said portion of the part 8 where they risk creating an electrical field that counters the acceleration of the electrons from the second end to the first end of the rod 3.

Figure 2:
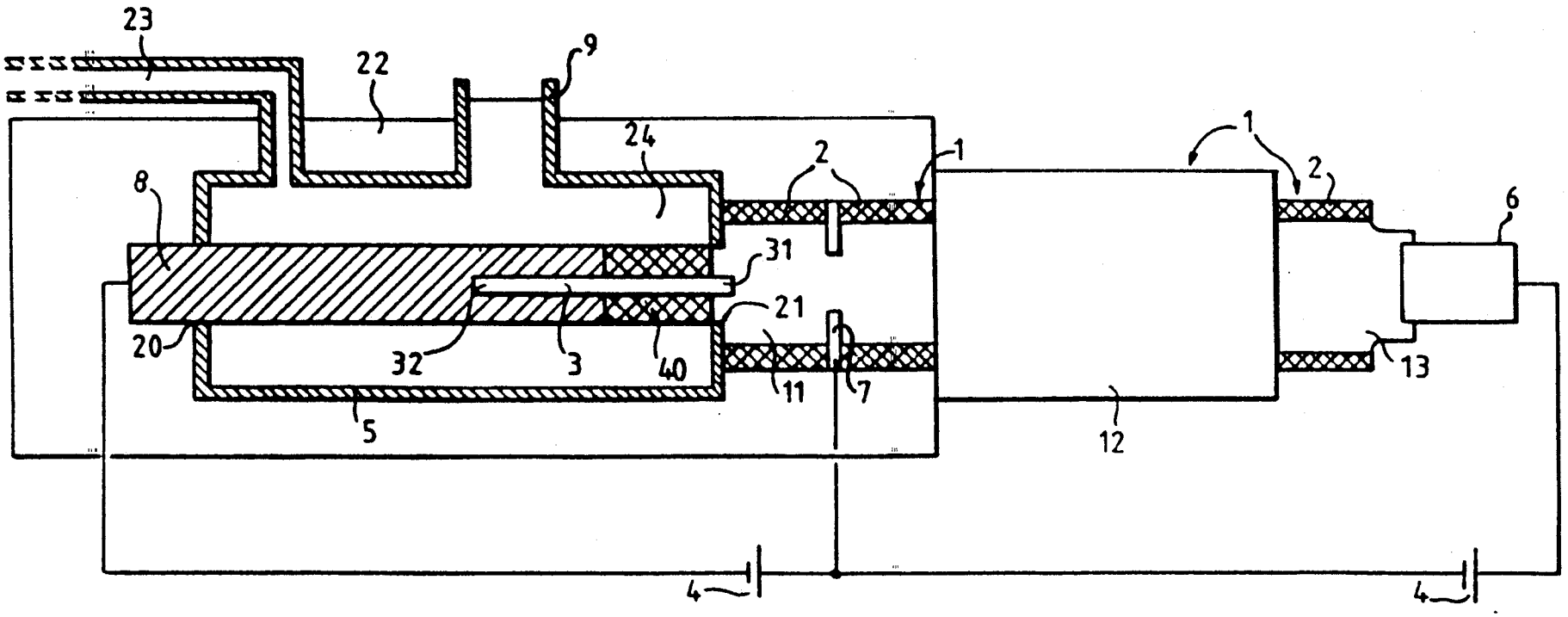
FIG. 2 shows a section of a second embodiment of the device according to the invention.
Figure 3:
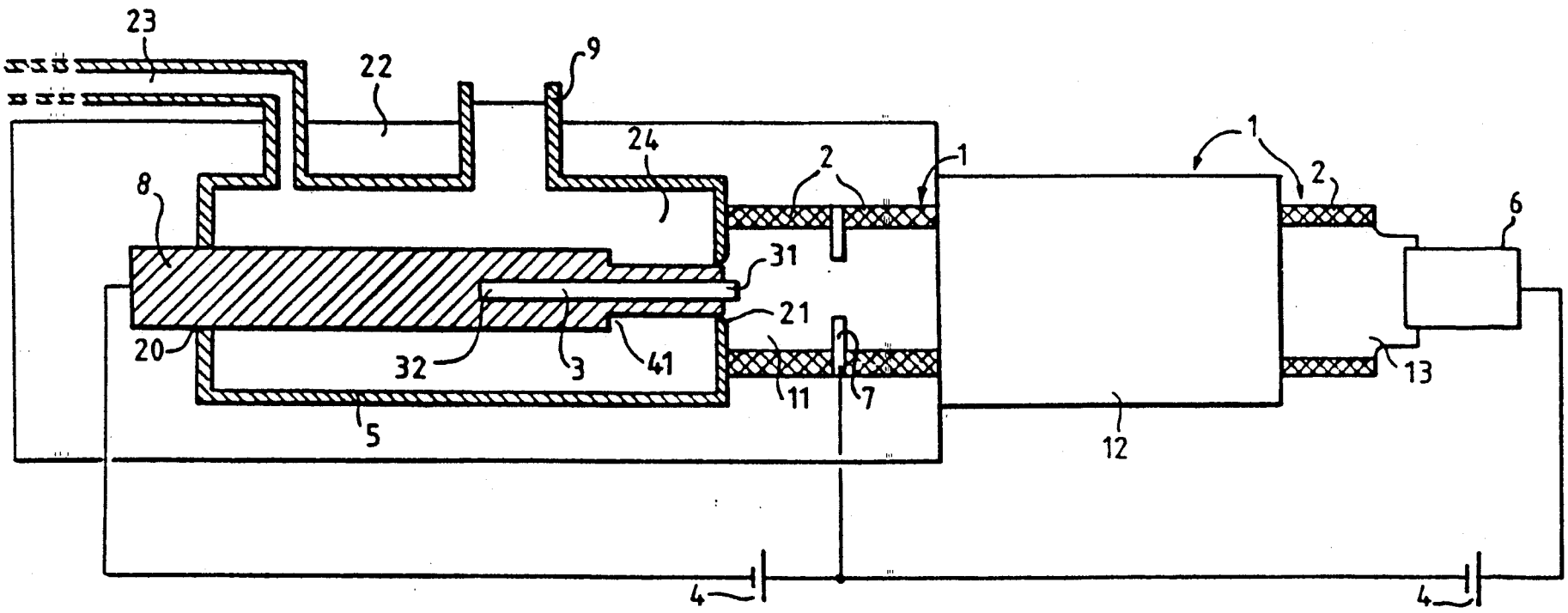
FIG. 3 shows a section of a third embodiment of the device according to the invention.
Figure 4:
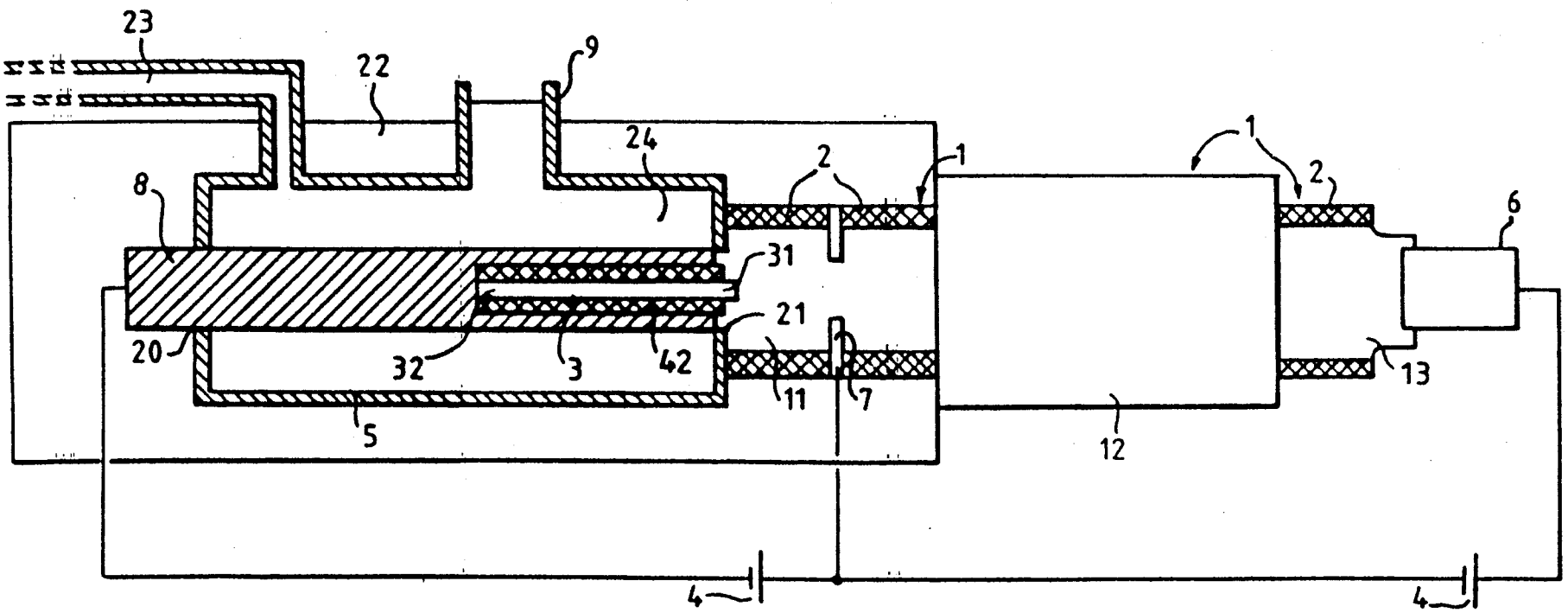
FIG. 4 shows a section of a fourth embodiment of the device according to the invention.

There are several possible ways to reduce the number of residual electrons that have thus collected. FIGS. 2 to 4 illustrate approaches of this type.

The second embodiment of the device according to the invention, illustrated by FIG. 2, differs from the first one, illustrated by FIG. 1, in that the rod is embedded in the part 8 only on one part of its length. In other words, the part 8 of FIG. 2 is shorter than that of FIG. 1. This part 8 is partially replaced by a sleeve 40, made of an electrically conductive material, for example ceramic, surrounding that part of the rod 3 which is not embedded in the part 8, and being rigidly fixed to the part 8. As an example, the part 8 is made of copper, and the sleeve 40 is made of ceramic, thus enabling a fixing, such as this, to be done by brazing. The sleeve, which is electrically insulating, forces the electrons to go into the superconductive rod 3 at the fixing of the part 8 to the sleeve 40 so that these electrons are accelerated over a distance at least equal to the length (hereinafter called a minimal distance) of that part of the rod 3 which is not embedded in the part 8. By stipulating that this minimum distance should greater than a pre-determined value which can be known to those skilled in the art, it is possible to prevent the drawback of the device of FIG. 1, explained above. The transversal dimensions of the sleeve 40 are, for example, substantially identical to those of the part 8, but they could equally well be smaller than those of this part 8. The rest of the description of FIG. 2 is analogous to that of FIG. 1, except that the tank 5 grips the sleeve 40 instead of the part 8 at the third hole 21.

The device illustrated in FIG. 3 differs from that illustrated in FIG. 1, in that the part 8 has a shoulder 41, that portion of this part 8 located on the injection part 11 side of the tube 1 having transversal dimensions that are smaller than those of the rest of the part 8. The existence of a shoulder 41 of this type modifies the electrical field lines in the part 8, in a manner known to those skilled in the art. This forces a portion of the residual electrons to go into the rod 3 at this shoulder 41. In choosing the position of the shoulder 41, it is possible to reduce the drawback of FIG. 1, referred to above.

The device of FIG. 4 differs from that of FIG. 1 in that the rod 3 is surrounded by a sheath 42, made of an insulating material, substantially over its entire length, except for its two ends 31 and 32. The rod 3, surrounded by this sheath 42, is embedded substantially throughout the length of the sheath 42 in the part 8, on the second end 32 side of the rod 3, so as to leave the first end 31 of the rod 3 free. In the configuration of FIG. 4, the tank 5 grips a portion of the part 8 at the third hole 21 (whereas in the configuration of FIG. 2, the tank 5 clamps the sleeve 40). This enables a brazing between metals to be made advantageously (in effect, the part 8 is made of copper and the tank is made of Kovar for example). The device of FIG. 4 works similarly to that of FIG. 2, except that the electrons are accelerated over substantially the entire length of the rod 3.

Figure 5:
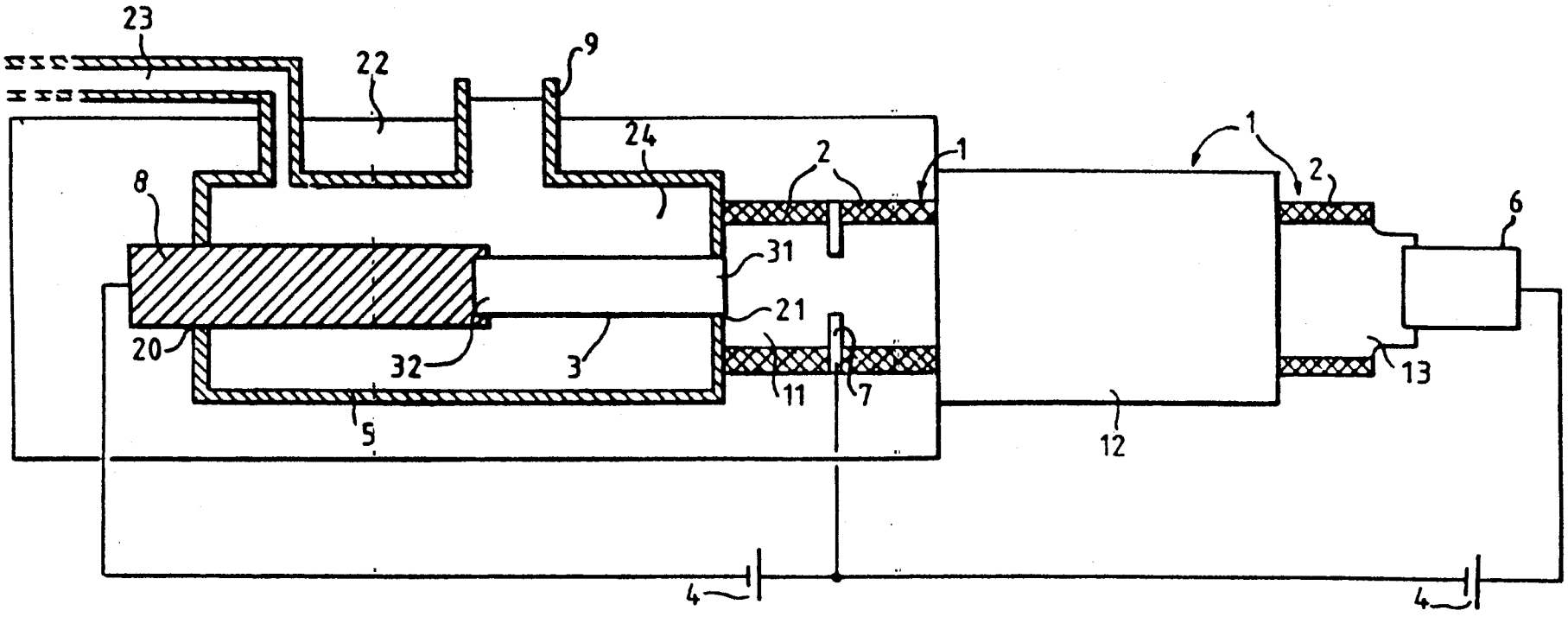
FIG. 5 shows a section of a fifth embodiment of the device according to the invention.

FIG. 5 illustrates a fifth embodiment of the invention, which differs from the former one in that the rod 3, embedded in the part 8, is replaced by a bar 3 (made of a superconductive material), the transversal dimensions of which are only slightly smaller than those of the part 8, the bar being rigidly fixed to the part 8 by means known per se, for example, by the embedding of its second end 32 (located on the supply means 4 side). In the case of the device of FIG. 5, the tank directly grips the superconductive bar 3 at the third hole 21. The device of FIG. 5 works in the same way as that of FIG. 1, but does not have the above-described drawback. All the electrons given by the supply means 4 go from the part 8 into the superconductive bar 3 at the fixing of the part 8 to the bar 3, and are therefore accelerated over substantially the entire length of the bar 3. The result obtained with the device of FIG. 5 differs from that of the device of FIG. 1 in the transversal dimensions of the electron beam injected into the tube, the number of electrons injected per section unit of the beam being the same as for FIG. 1.

Devices that work according to the same principle as those of FIGS. 1 to 5 and have different geometries are clearly within the scope of the invention.

What is claimed is:

1. A device for the injection of electrons into an electron tube, comprising:

a bar of pre-determined length made of a superconductive material having a pre-determined energy of extraction, a first end of said bar entering an injection part of said tube;

electrical supply means enabling the application of a main voltage between a first end of said bar, said bar acting as a cathode, and a main anode located in a receiving part of said tube, said voltage enabling electrons to be accelerated along said bar, so as to acquire a kinetic energy which is at least equal to the energy of extraction from the material forming the bar, and so as to be ejected outside said bar, through said bar's first end, and be injected into said injection part of said tube;

means to trigger the electron injection phenomenon.

2. A device according to claim 1, wherein the triggering means comprises a secondary anode located in said injection part of said tube, said electrical supply means further providing for the application of a secondary voltage between the cathode and this secondary anode, said secondary voltage being taken to a starting up voltage, which is high and independent of the main voltage, to trigger the phenomenon of injection of electrons into the tube, and then reduced to a lower operating voltage, which is below the main voltage, during the operation of the device.

3. A device according to claim 1, further comprising a first conductive part made of an electrically conductive material, providing for the electrical connection between said electrical supply means and said bar and in which said bar is partially embedded for reinforcing the mechanical rigidity of said bar.

4. A device according to claim 1, further comprising cooling means that maintain the material forming said bar in a superconductive state.

5. A device according to claim 4, further comprising a first conductive part made of an electrically conductive material, providing for the electrical connection between said electrical supply means and said bar and in which said bar is partially embedded for reinforcing the mechanical rigidity of said bar, wherein said cooling means comprises a tank, filled with a cooling liquid, exposed to the open air by a first hole and connected to a reservoir of the cooling liquid by means of a conduit, comprising a second hole that tightly grips a portion of said first conductive part which is located opposite said bar, and comprising a third hole surrounding said first end of the bar and opening into said injection part of the tube, thus confining the cooling liquid in the tank, the cooling liquid immersing said first conductive part and the bar, said immersion providing for their cooling.

6. A device according to claim 5, wherein said cooling fluid is liquid nitrogen.

7. A device according to claim 5, further comprising thermal insulation means surrounding, at the same time, almost the entire tank and at least a portion of said injection part of said tube.

8. A device according to claim 5, wherein:

said bar is a rod;

said first conductive part extends in the direction of said rod and its transversal dimensions are greater than those of said rod, said rod being partially embedded, on its second end side, in said first conductive part, the first end of said rod remaining free.

9. A device according to claim 8, wherein the rod is embedded in said first conductive part, substantially throughout its length except for its first end, said third hole tightly gripping a portion of said first conductive part which is located on the side of said injection part of the tube.

10. A device according to claim 9, wherein said first conductive part comprises a shoulder, the portion of said first part located on the side of said injection part of the tube having transversal dimensions that are smaller than those of the rest of said conductive part.

11. A device according to claim 8, wherein the rod is embedded in said first conductive part only along one portion of its length, that part of the rod which is not embedded in said first conductive part being surrounded by a sleeve made of an electrically insulating material and being rigidly fixed to said first conductive part, with said third hole tightly gripping a part of said sleeve.

12. A device according to claim 11, wherein the transversal dimensions of said sleeve are substantially the same as those of said first conductive part.

13. A device according to claim 11, wherein the transversal dimensions of said sleeve are smaller than those of said first conductive part.

14. A device according to claim 3, wherein:

said bar is a rod;

said first conductive part extends in the direction of said rod and its transversal dimensions are greater than those of said rod, the device further has an external sheath surrounding said rod substantially throughout its length except for its ends; said rod and said sheath being embedded, substantially throughout the length of said sheath and on the second end side of said rod, in said first conductive part, the first end of said rod remaining free.

* * * * *